US006752263B2

(12) United States Patent
Dubsky

(10) Patent No.: US 6,752,263 B2
(45) Date of Patent: Jun. 22, 2004

(54) CONTAINER FOR AN OBJECT WHICH CAN BE REFOLDED TO SERVE OTHER PURPOSES

(76) Inventor: Stephanie Dubsky, 162 E. 90th St., Apt. 5R, New York, NY (US) 10128

( * ) Notice: Subject to any disclaimer, the term of this patent is extended or adjusted under 35 U.S.C. 154(b) by 71 days.

(21) Appl. No.: 10/026,173

(22) Filed: Dec. 20, 2001

(65) Prior Publication Data

US 2003/0116451 A1 Jun. 26, 2003

(51) Int. Cl.[7] ..... B65D 77/00

(52) U.S. Cl. ..... 206/216; 206/418; 229/103; D26/128

(58) Field of Search ..... 229/103, 116.1; D26/118, 128; 362/311; 206/418, 422, 216, 45.2, 45.21, 767, 45.28, 45.29, 775

(56) References Cited

U.S. PATENT DOCUMENTS 1,875,455 A * 9/1932 Hayes et al. ..... 206/418
2,486,045 A * 10/1949 Madden et al. ..... 229/117.24
3,075,074 A 1/1963 Asher
3,109,252 A * 11/1963 Schellenbarg ..... 40/554
3,119,494 A * 1/1964 Rosenstiel ..... 206/216
4,033,068 A 7/1977 Skillman
4,058,211 A 11/1977 Barbieri et al.
4,498,580 A 2/1985 Getz et al.
4,572,362 A 2/1986 Kronfeld
6,059,179 A * 5/2000 Giampapa ..... 229/103
6,126,300 A 10/2000 Lee

* cited by examiner

*Primary Examiner*—Jila M. Mohandesi
(74) *Attorney, Agent, or Firm*—Kenyon & Kenyon

(57) ABSTRACT

An article of manufacture is provided. The article of manufacture includes a sheet of foldable material. The sheet of foldable material is configured to be folded a first way to form a container for an object. The sheet of foldable material is configured to be folded a second way to form a shade.

19 Claims, 21 Drawing Sheets

CONTAINER FOR AN OBJECT WHICH CAN BE REFOLDED TO SERVE OTHER PURPOSES

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

BACKGROUND

Boxes for light bulbs or other objects are well known. U.S. Pat. No. 4,498,580 to Getz describes a box for a light bulb where the inserted bulb is held in place within the carton by a pair of apertured partition panels. U.S. Pat. No. 4,058,211 to Barbieri describes a box for an electric light bulb. The box includes an open-ended corrugated paperboard wrapper that is slip-fitted into an open-ended boxboard sleeve.

Collapsible lamp shades are also known. U.S. Pat. No. 3,075,074 to Asher describes a collapsible lamp shade. U.S. Pat. No. 6,126,300 to Lee describes a multi-configuration lampshade which is shippable in a reduced volume configuration and expandable to an operative, increased volume configuration. The Lee lampshade is molded from a rigid plastic such as polypropylene in the form of a frustrated cone.

Structural modules and lamp shades have also been constructed from single sheets of various materials. U.S. Pat. No. 4,033,068 to Skillman describes a structural module which may be formed from a folded sheet. Multiple structural modules may be assembled to produce a variety of structures. The light shade of Sebastien Bergne from the Radius firm, Apostelnstrasse 24, 50667 Koln, Germany 41, can be pulled directly over a light bulb in two possible configurations, one forming a shade below the bulb and a second forming a reflector above the bulb.

DETAILED DESCRIPTION OF THE EXAMPLE EMBODIMENTS

According to an example embodiment of the present invention, a sheet of foldable material may be configured to allow the sheet to be folded to form a container for an object, e.g., a box for a light bulb, a container for a flower bulb, etc. The container for the object may be unfolded, and the sheet of foldable material may be refolded to form a basket-shaped object, e.g., a light shade.

Figure 1:
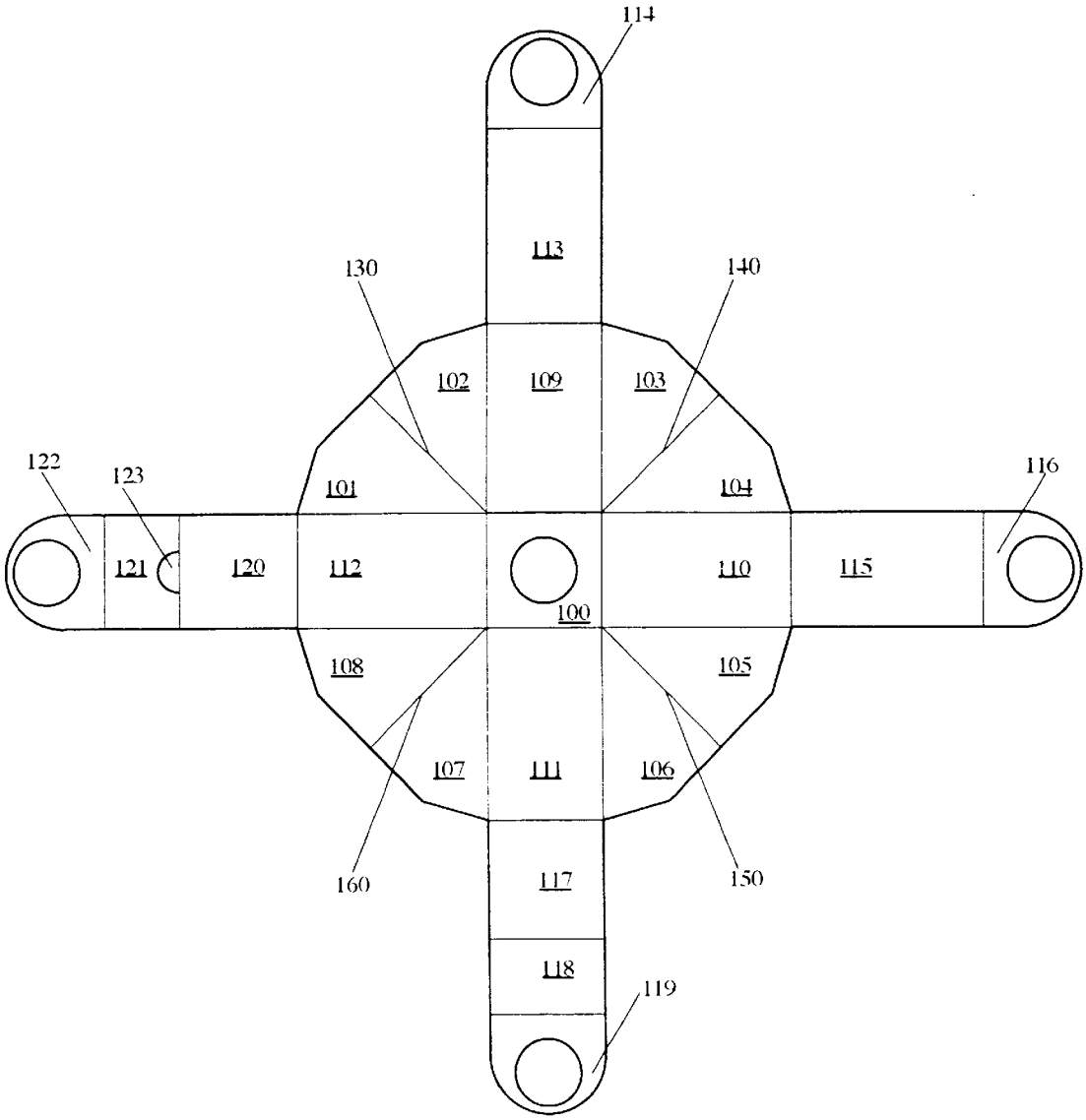
FIG. 1 illustrates an example unfolded sheet, according to an example embodiment of the present invention.

FIG. 1 illustrates an example unfolded sheet, according to an example embodiment of the present invention. The example unfolded sheet may be formed from a foldable material, e.g., paper, cardboard, metal mesh, metal foil, plastic, etc. If the sheet is used to form a shade for a light bulb, it will be appreciated that the foldable material may need to have the appropriate heat and fire resistant properties. Fold lines for forming the container for an object and the basket-shaped object may be marked on the foldable sheet, e.g., by printing, perforating, or scoring the foldable sheet. The presence of the fold lines may facilitate the proper folding of the unfolded sheet into various folded forms. The example unfolded sheet may also be divided into sections, that may but need not, be bounded by the fold lines. The divisions into sections and the fold lines may be marked, e.g., with printed lines or perforations.

The example unfolded sheet may include a center section 100. The center section may contain an aperture, although depending on the intended uses for the sheet, this aperture may be omitted. If the sheet is to be used as a light bulb box, the aperture may be circular, as in conventional light bulb boxes. The aperture may allow the purchaser of a light bulb to determine the type and wattage of the bulb by inspecting it through the opening.

The example unfolded sheet may contain intermediate panels 101–108, and side panels 109–112. The intermediate panels 101–108 and side panels 109–112 may be disposed in a radial fashion, with two intermediate panels between each pair of side panels. The side panels 109–112 are illustrated in FIG. 1 as rectangles, and the intermediate panels 101–108 are illustrated as wedge shapes, but it will be appreciated that other shapes may be employed. Each pair of adjacent side panels may be connected by a pair of side panels, e.g., panels 109 and 110 may be connected by panels 103 and 104, with panel 103 joined to panel 109 and panel 104 joined to panel 110, and panels 103 and 104 joined to each other.

The example foldable sheet may include one or more radially extending members, e.g., four such radially extending members are included in the example foldable sheet illustrated in FIG. 1. Each radially extending member may include a connecting panel, which may be joined to a side panel. For example, a connecting panel 113 may be joined to side panel 109. Similar connecting panels 114–116 may be joined to side panels 110–112, respectively. It will be appreciated that the extending members could have other dimensions, or take on other shapes, e.g., the extending members might extend tangentially to the end of the connecting panels.

The first radially extending member may be formed by panels 113 and 114. The connecting panel 113 may connect side panel 109 to an attachment panel 114. The panel 114 may be configured to form an attachment, for attaching the first radially extending member to another object or to another component of the foldable sheet. For example, as illustrated in FIG. 1, the panel 114 may be a semicircular panel which includes a ring shaped opening to form loop. However, it will be appreciated that the attachment 114 need not be ring shaped, e.g., it may include a hook, a loop of wire joined to a panel, a velcro closure, a snap, a closable clasp, or any other structure that could be used for attachment to another object. It will also be appreciated that the opening need not be present in the attachment panel when it is manufactured and distributed, e.g., the attachment panel may include a perforated disk that could be removed by an end user of the unfolded sheet.

Panels 115 and 116 may form a second radially extending member of the example foldable sheet. Side panel 110 may be connected via connecting panel 115 to attachment panel 116.

Panels 117, 118, and 119 may form a third radially extending member of the example foldable sheet. Side panel 111 maybe joined to connecting panel 117, which may be in turn be joined to fold under connecting panel 118, which in turn may be joined to attachment panel 119.

Panels 120, 121, and 122, may form a fourth radially extending member of the example foldable sheet. Side panel 112 may be joined to connecting panel 120, which may be joined to fold under connecting panel 121, which may be joined to attachment panel 122. Fold under connecting panel 121 may include a tab 123. The tab may be a half circle, although it will be appreciated that other shapes may be used. Like the openings in the attachment panels, the tab 123 may be perforated and punched out by an end user. Alternatively, the tab may be omitted, or may be marked by a pre-printed line and cut out by hand, although this approach may make the use of the unfolded sheet more complex.

It will be appreciated that radially extending members and attachment panels need not be present for each side panel. Depending on the particular design, and the strength and flexibility of the material from which the foldable sheet is manufactured, fewer attachment panels may be needed to allow the foldable sheet to be used as a shade, or to provide closures for the container that may be constructed from the foldable sheet. Alternatively, additional radially extending members may be desired for strength or aesthetic reasons. Individual extending members may also have additional panels, and need not have the exact two and three panel designs illustrated here.

It will also be appreciated that the example foldable sheet need not be fabricated as a single piece, although it has been found that this structure is preferable in terms of economy and simplicity. For example, the connecting panels and attachment panels may be fabricated separately, and joined to the side panels with staples, tape, tabs, adhesive, or any other known joining method.

Forming a Container from the Foldable Sheet

In an example embodiment according to the present invention, the foldable sheet may be folded to form a container for an object, e.g., a light bulb or flower bulb.

Figure 2:
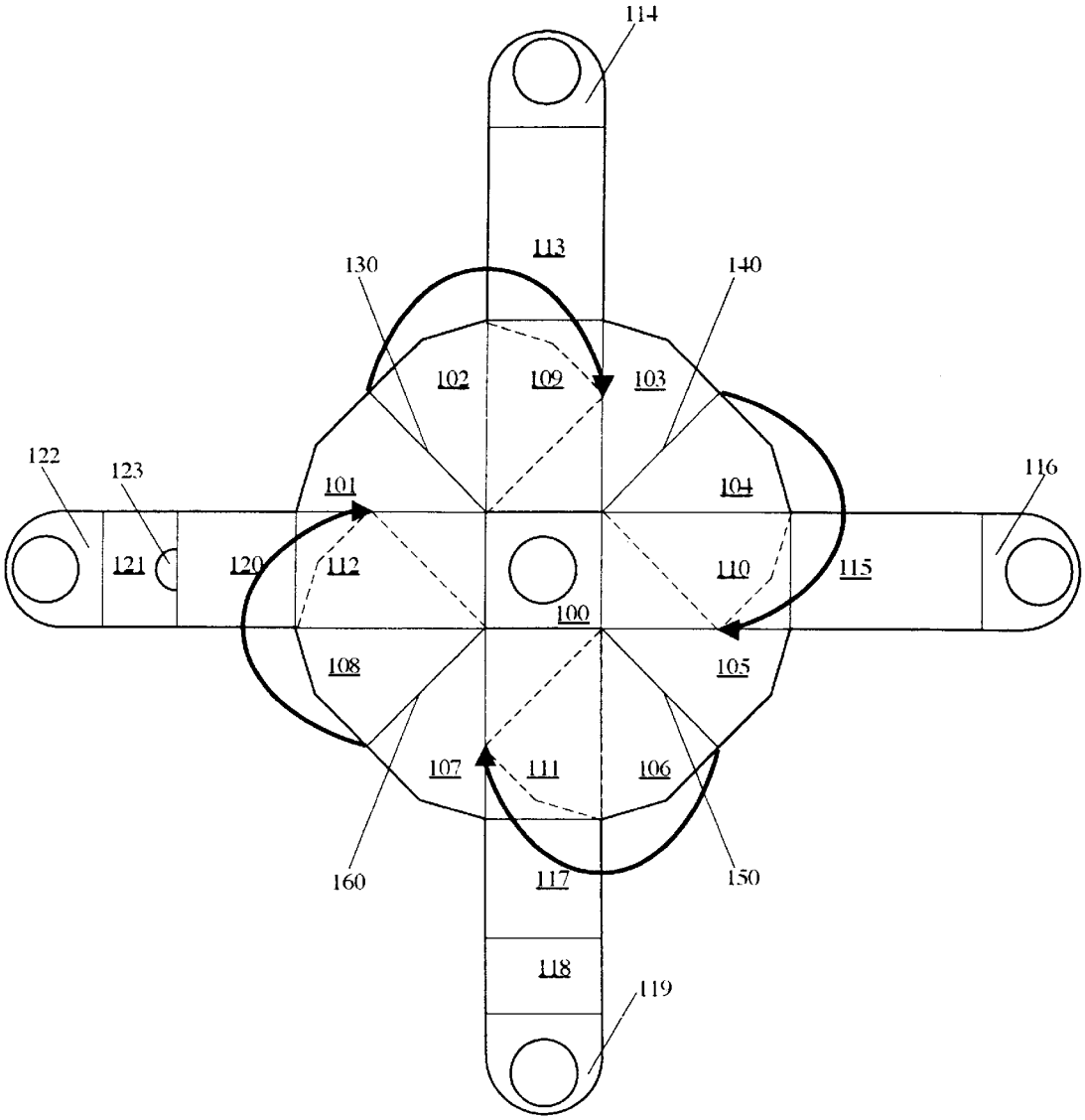
FIG. 2 illustrates initial steps of an example procedure for folding the example foldable sheet into an example container for an object, according to an example embodiment of the present invention.

FIG. 2 illustrates initial steps of an example procedure for folding the example foldable sheet into an example container for an object, according to an example embodiment of the present invention. If beginning with a flat sheet the foldable sheet may be creased before folding it to form the container for an object. For example it may be useful to crease along the fold line between panels 110 and 112 and panels 101 and 104, and along all similar fold lines that run parallel to the radially extending members. Next, the fold line 130 between panels 101 and 102 may be pulled inward. Similarly, the fold lines 140, 150, and 160 between panels 103 and 104, 105 and 106, and 107 and 108, respectively, may be pulled inward. Next, panel 102 may be folded against one of the side panels, e.g., panel 109, by pulling the outermost point on fold line 130 over to the fold line between panels 109 and 103, as illustrated in FIG. 2. Panel 1 may be folded against panel 102. Similarly, panels 103 and 104 folded against side panel 110, by pulling the outermost point on fold line 140 over to the fold line between panels 110 and 105. Panels 105 and 106 may be folded over side panel 111 by pulling the outermost point on fold line 150 over to the fold line between side panel 111 and panel 107. Panels 107 and 108 may be folded over side panel 112 by pulling the outermost point on fold line 160 over to the fold line between side panel 112 and intermediate panel 101. The result is a container open at one end and closed at the other, with the four radially extending members extending from the top of the container.

Figure 3:
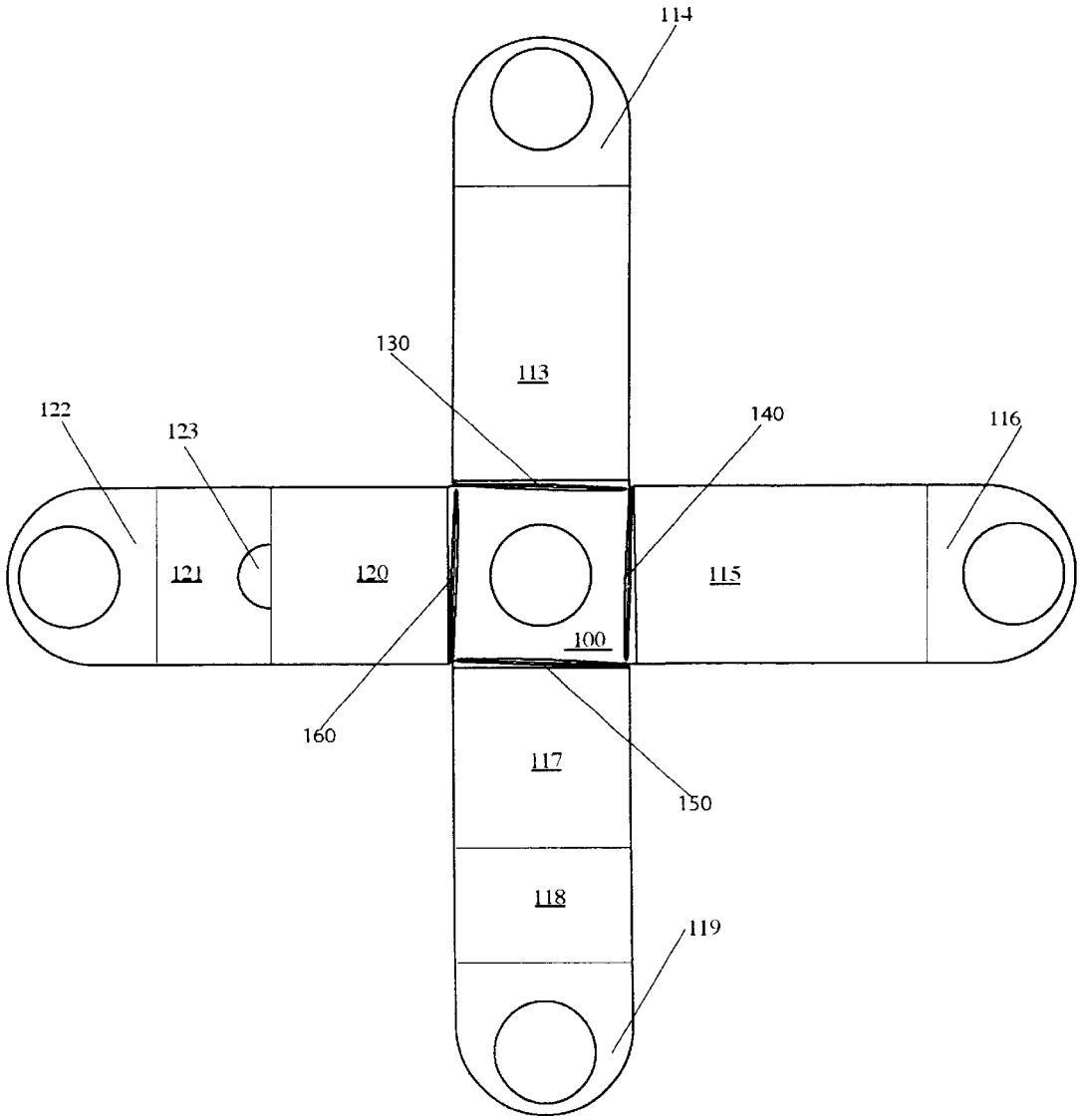
FIG. 3 illustrates a top view of the partially formed example container for an object, after the initial steps of an example procedure for folding the example foldable sheet into an example container for an object have been completed, according to an example embodiment of the present invention.

FIG. 3 illustrates a top view of the partially formed example container for an object, after the initial steps of an example procedure for folding the example foldable sheet into an example container for an object have been completed, according to an example embodiment of the present invention. It will be appreciated that, in FIG. 3, the side panels and intermediate panels are visible only as lines because of the end-on perspective employed in the figure.

Figure 4:
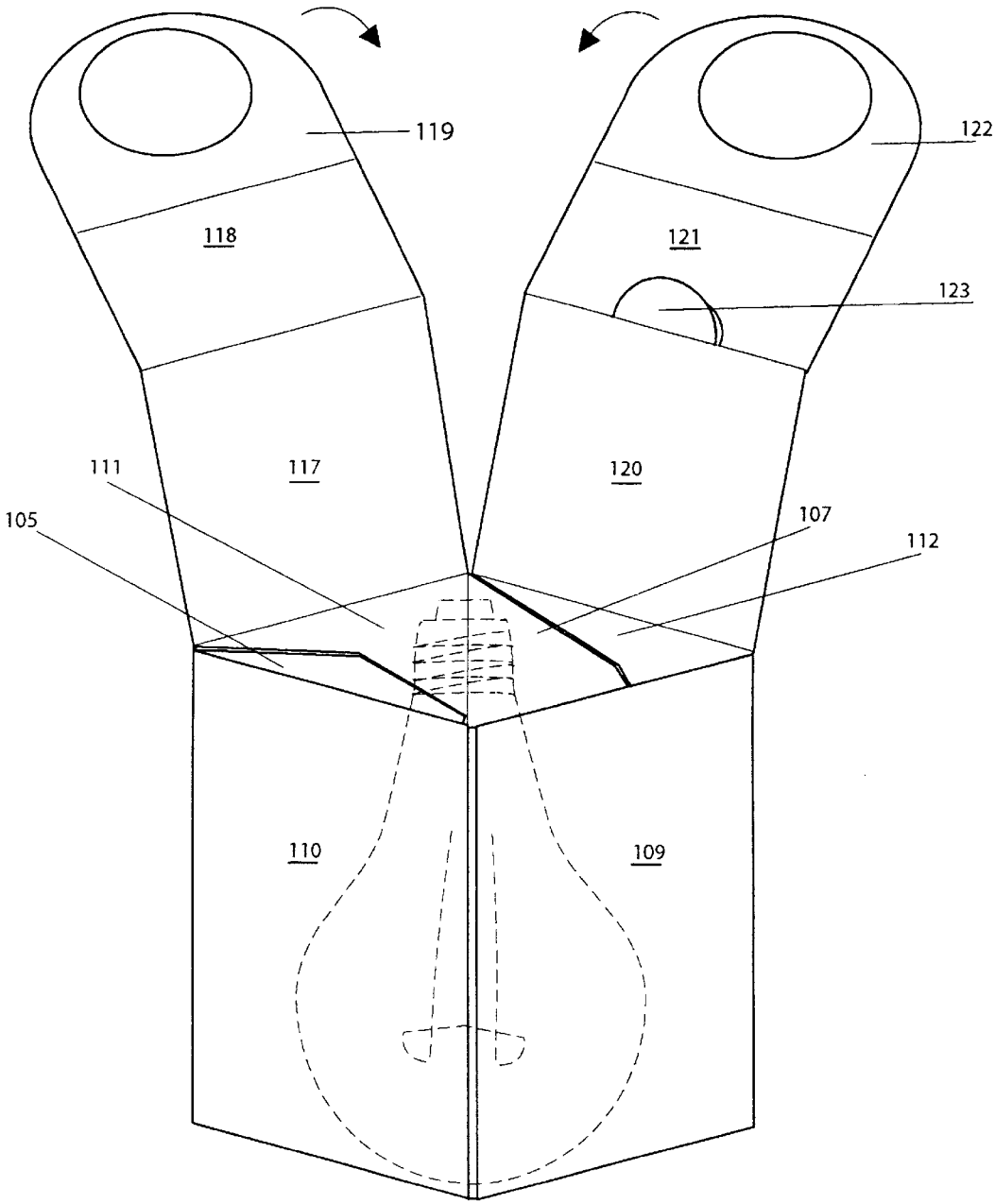
FIG. 4 illustrates the use of an example foldable sheet as an example container for an object, according to an example embodiment of the present invention.

FIG. 4 illustrates the use of an example foldable sheet as an example container for an object, according to an example embodiment of the present invention. The container may be suitable for holding many types of objects, e.g., a conventional light bulb. It will be understood that the light bulb, shown in FIG. 4 with dotted lines, is not part of the example embodiment of the present invention, but is merely included for illustration. It will be appreciated that the example container may also be used to hold other types of objects, as well as for other purposes.

In the example container, side panels 109 and 110 may form two of the outer walls of the container. Side panels 111 and 112 may also form two outer walls whose outer surfaces are not shown, given the perspective of FIG. 4. The intermediate panels, which may be folded inside the example container, may form a partial inner wall in the example container. This inner wall may cushion or help secure an object held in the example container.

Two of the extending members may be folded inside the container. The folding of the extending members inside the box may secure the intermediate panels that were already folded in, as described previously. The folding of the extending members inside the box may add an additional layer to the inside of the container, resulting in additional cushioning and the ability to secure the object inside the container. In the example foldable sheet, the extending members with panels 113 and 114 and with panels 115 and 116 may both be configured to be folded in to the container, with the attachment panels 114 and 116 folded along the bottom of the container.

The extending member which includes panels 117, 118, and 119, may be used to form a closure for the top of the container. Connecting panel 117 may form the lid or end panel for the top of the container. Panel 118 and attachment panel 119 may form a closure tab which may be tucked in to secure the closure of the container. Similarly, the extending member that include panels 120, 121, and 122, may form a second closure for the top of the container. Connecting panel 120 may form a lid or end panel for the top of the container. Panels 121 and attachment panel 122 may form a tab, which may be tucked in to secure the closure the end of the container. When the second closure is closed, tab 123 may be left in a protruding position, facilitating the opening of closures.

Figure 5:
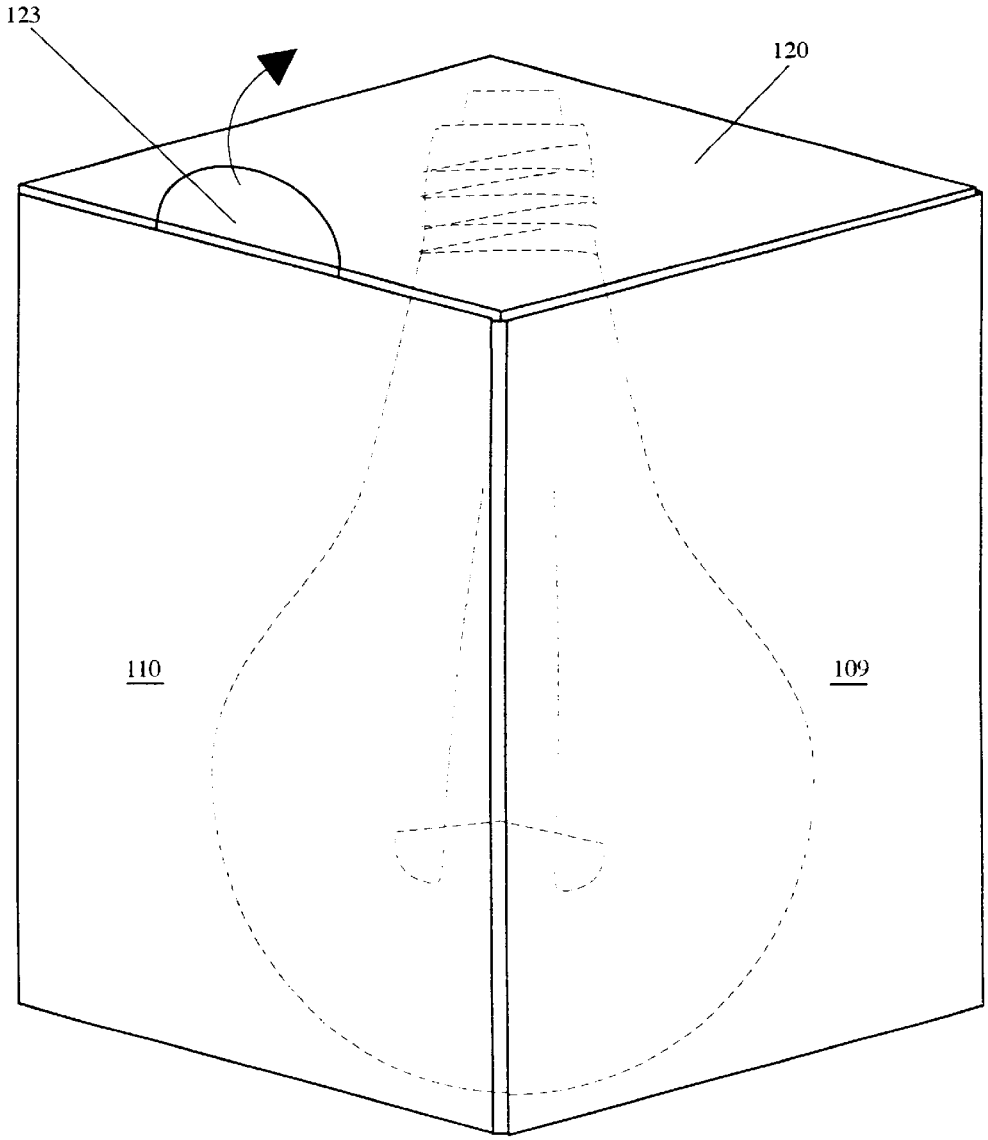
FIG. 5 illustrates the example container for an object when the top of the container is closed, according to an example embodiment of the present invention.

FIG. 5 illustrates the example container for an object when the top of the container is closed, according to an example embodiment of the present invention. It will be understood that the light bulb, shown in FIG. 5 with dotted lines, is not part of the example embodiment of the present invention, but is merely included for illustration. As can be seen from FIG. 5, tab 123 may be pulled to open the container for the object. A foldable sleeve may be slipped over the example container to further or secure or cushion it, as in conventional light bulb containers.

It will be appreciated that the example container folded from the example foldable sheet may include a smaller or greater number of extending members. It will also be appreciated that a greater or smaller number of the extending members may be folded inside the container, or used to form closures, e.g., all the extending members may be folded inside, forming an open-ended container, or all the extending members may be used to close the end of the container.

It will be appreciated that various panels of the foldable sheet might be formed of multiple layers, e.g., a corrugated layer, in order to enhance the cushioning and securing properties of the internal walls of the example container for an object. It will also be appreciated that the example container for an object may include additional components, e.g., an additional sleeve may be inserted inside the container, to increase padding or better secure an object contained in the example container. Cap type lids may be included on either end, e.g., to better secure and pad the ends of the container.

Forming an Example Shade from Example the Foldable Sheet

The example foldable sheet may also be folded into a first example type of shade for a light. It will be appreciated that the example foldable sheet may also be folded into other similarly-shaped objects, e.g., a flower basket, a shade for a candle, etc.

Figure 6:
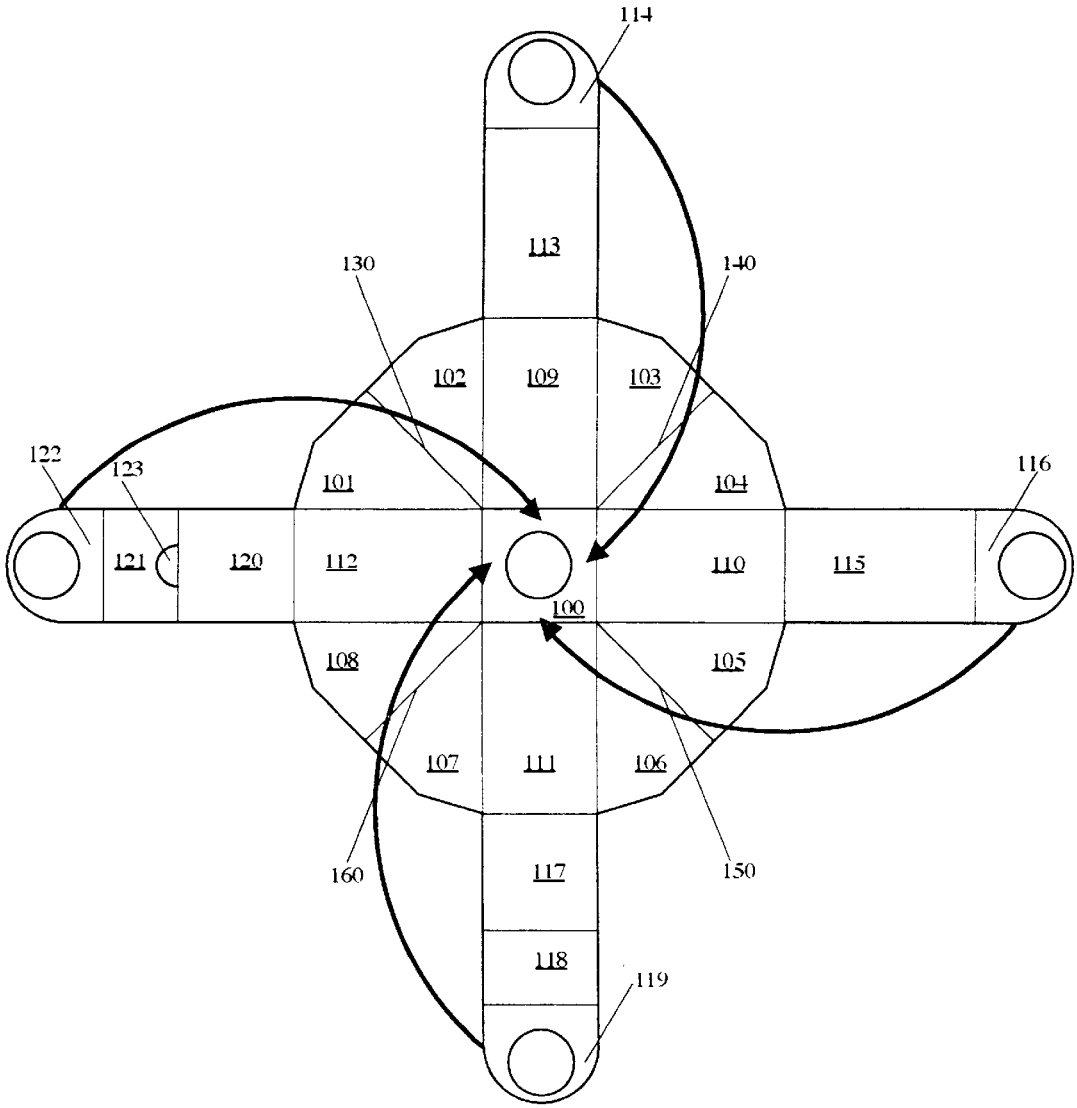
FIG. 6, illustrates the initial steps in an example procedure for forming the first example type of shade, according to an example embodiment of the present invention.

FIG. 6, illustrates the initial steps in an example procedure for forming the first example type of shade, according to an example embodiment of the present invention. As an initial step, the fold lines 130, 140, 150, and 160 maybe pulled inwards, towards the center of the example foldable sheet. It will be appreciated, that the fold lines may also be pulled inward later in the example procedure. The extending member including attachment panel 114 maybe folded inwards so that the attachment panel is roughly over the base panel 100. The extending member including attachment panel 116 may then be folded over the base panel 100, so that the aperture in attachment panel 116 is aligned with the aperture in attachment panel 114. The extending member including attachment panel 119 may then be folded over the base panel 100, so that the aperture in attachment panel 119 is aligned with the apertures in attachment panels 114 and 116. The extending member including attachment panel 122 may then be folded over the base panel 100, so that the aperture in attachment panel 122 is aligned with the apertures in attachment panels 114 and 116 and 119.

Figure 7:
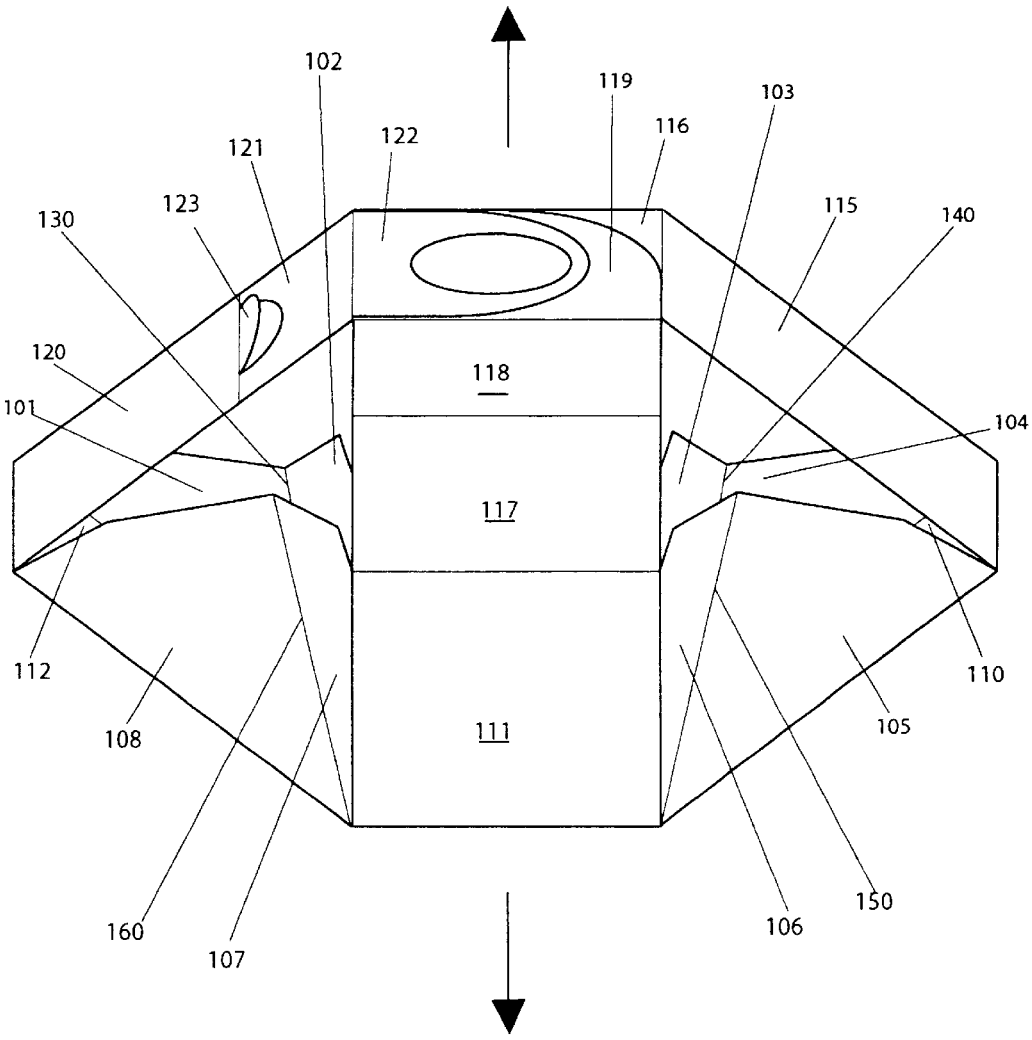
FIG. 7 illustrates the example shade that may be formed when the side panels and intermediate panels drop, according to an example embodiment of the present invention.

The attachment panels may then be held together, while the rest of the foldable sheet is allowed to drop. FIG. 7 illustrates the example shade that may be formed when the side panels and intermediate panels drop, according to an example embodiment of the present invention.

Figure 8:
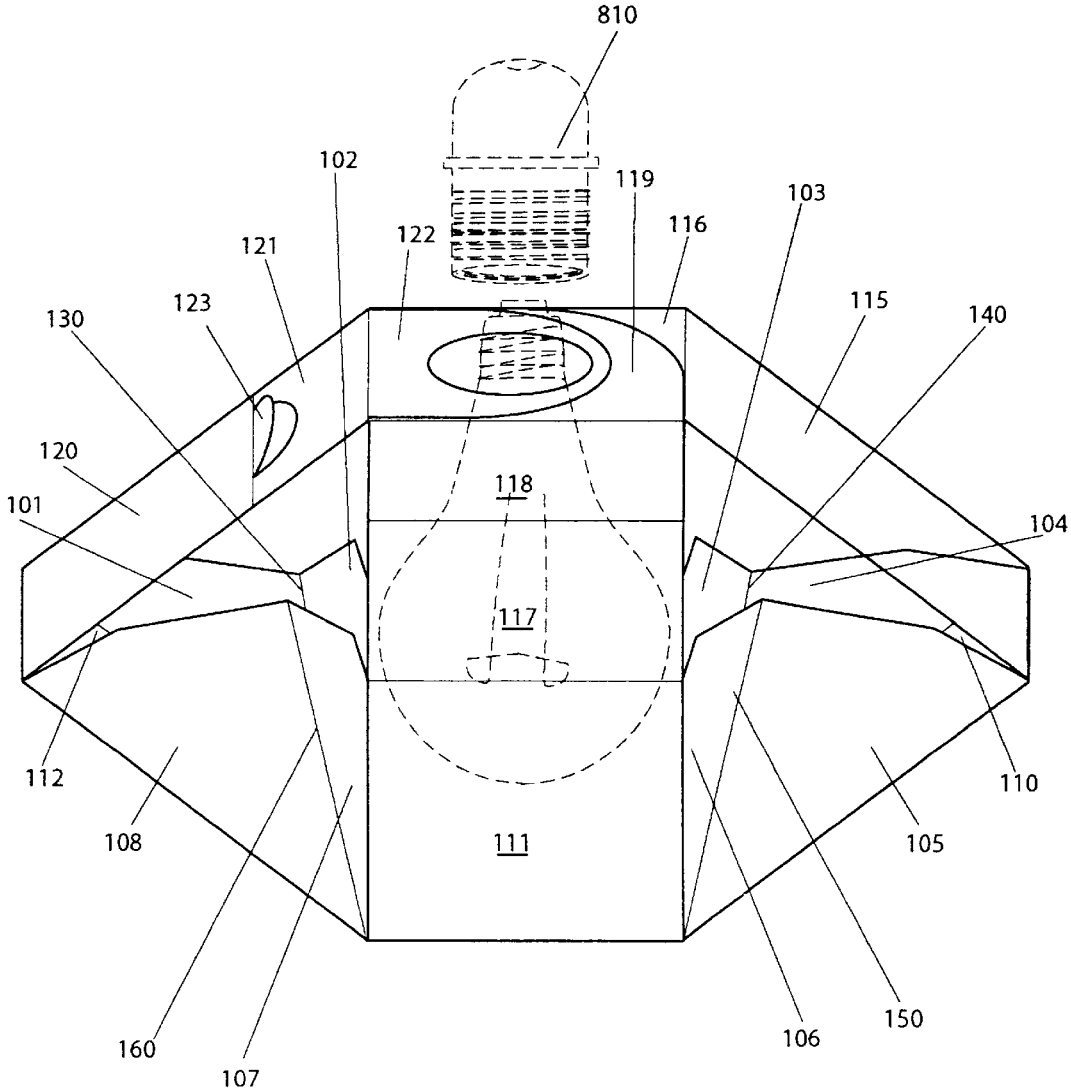
FIG. 8 illustrates a first example shade, according to an example embodiment of the present invention.

FIG. 8 illustrates a first example shade, according to an example embodiment of the present invention. A conventional screw type receptacle 810 is shown in dotted form for illustration, but is not part of the example embodiment. Similarly, a standard screw type bulb is also shown in dotted form, because it is shown for illustration, but is not part of the example embodiment.

Figure 9:
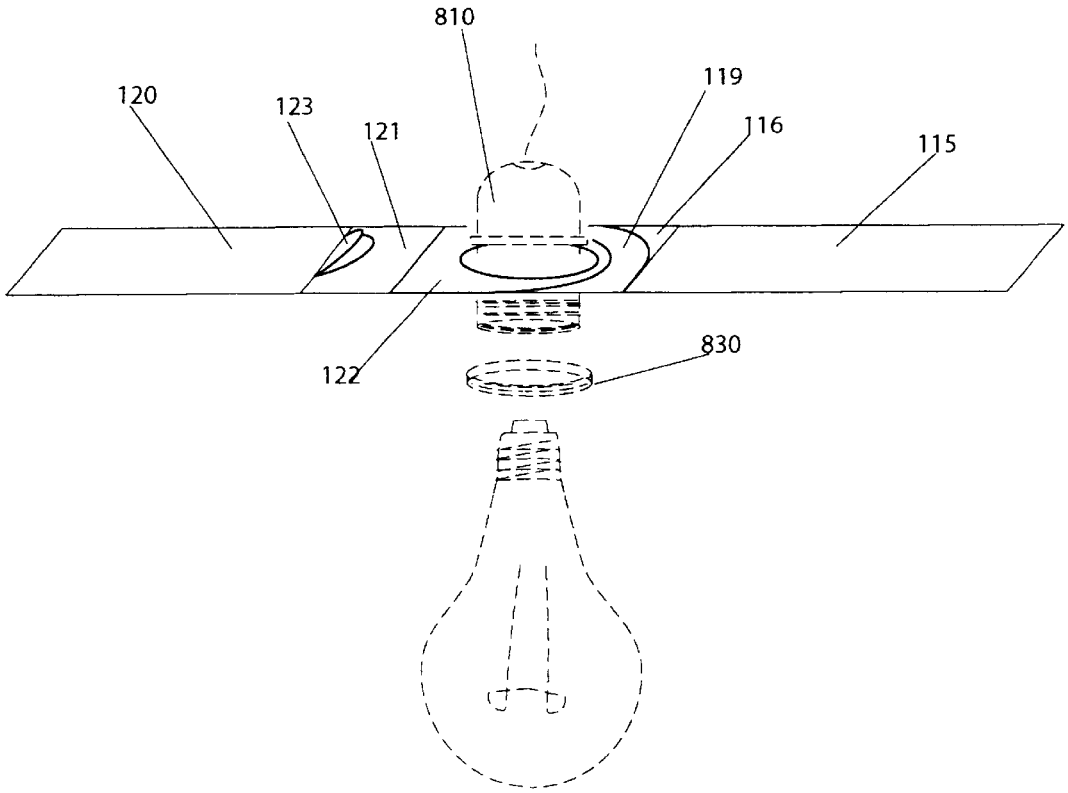
FIG. 9 illustrates a detailed view of an example procedure for attaching a receptacle to the attachment panels, according to an example embodiment of the present invention.

FIG. 9 illustrates a detailed view of an example procedure for attaching a receptacle to the attachment panels, according to an example embodiment of the present invention. In FIG. 9, the receptacle 810 may be attached to the attachment panels 114, 116, 119, and 122 of the example shade. A conventional screw type ring 830 may be used to secure the socket to the shade. When using the example shade, the screw type ring may also serve to attach the attachment panels of the extending members to each other. A conventional light bulb may then be inserted in the socket.

It will be appreciated that other forms of attachment may be used both to attach a light to the shade, and to attach the extending members to each other, e.g., Velcro, snaps, glue, etc.

Forming a Second and Third Example Shade from the Example Foldable Sheet

Figure 10:
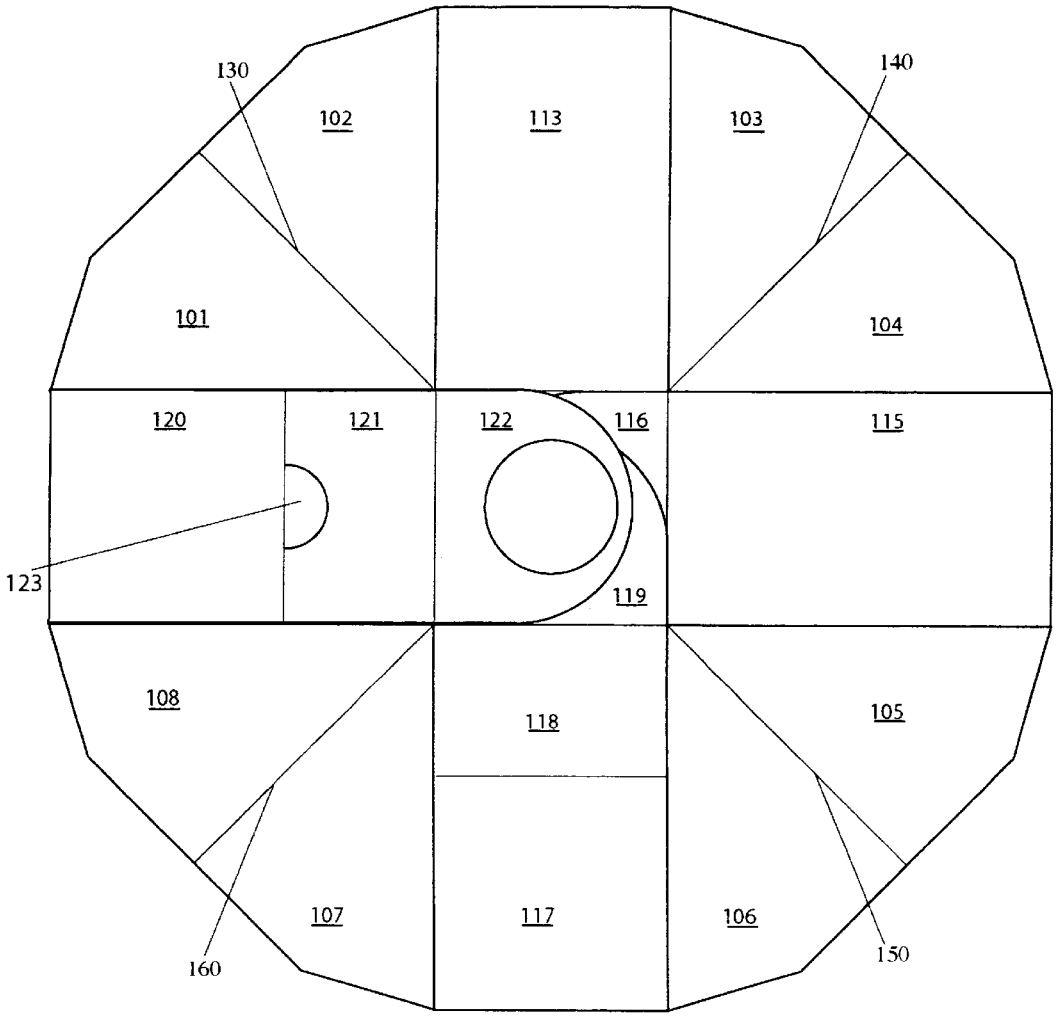
FIG. 10 illustrates the first steps in forming a second example shade from the example foldable sheet, according to an example embodiment of the present invention.

FIG. 10 illustrates the first steps in forming a second example shade from the example foldable sheet, according to an example embodiment of the present invention. Following the steps previously illustrated in FIG. 6, the extending members should be joined at the center of the sheet. Unlike the procedure used to form the first example shade, when forming the second example shade, care should be taken that the extending members lie flat against the other portions of the foldable sheet. It may be desirable to secure the extending members to the rest of the foldable sheet, using glue, snaps, the screw shell of a light bulb socket, or other techniques.

Figure 11:
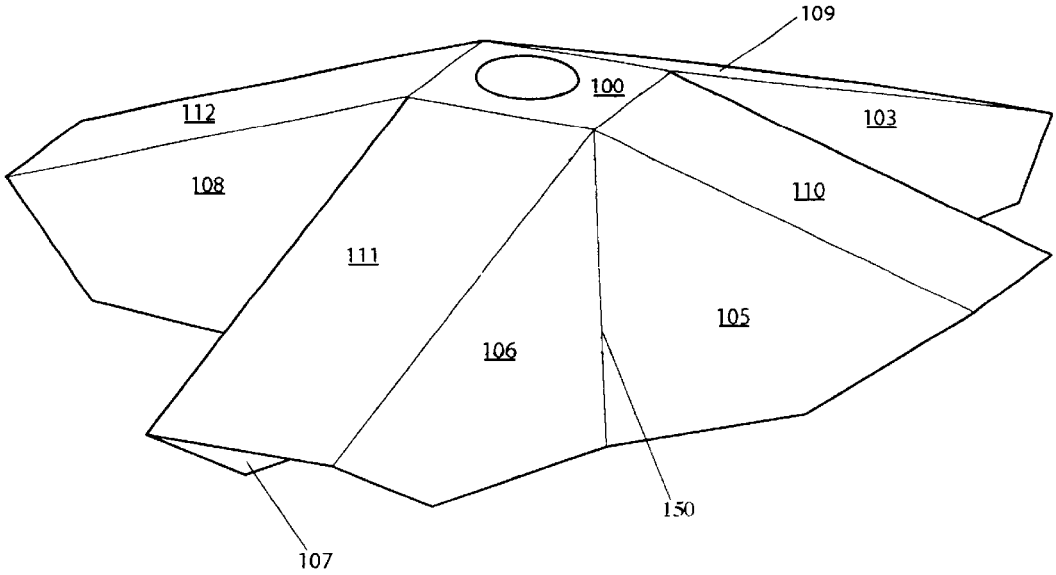
FIG. 11 illustrates a second example sheet formed from an example foldable sheet, according to an example embodiment of the present invention.

FIG. 11 illustrates a second example sheet formed from an example foldable sheet, according to an example embodiment of the present invention. The foldable sheet folded as shown in FIG. 10 may be placed with the extending member side down. The fold lines 130, 140, 150, and 160 can then pulled downwards. The shade illustrated in FIG. 11 may then be formed. The shade may be held together by a screw shell for a light bulb, or by other conventional attachments, e.g., glue, snaps, Velcro, etc.

Figure 12:
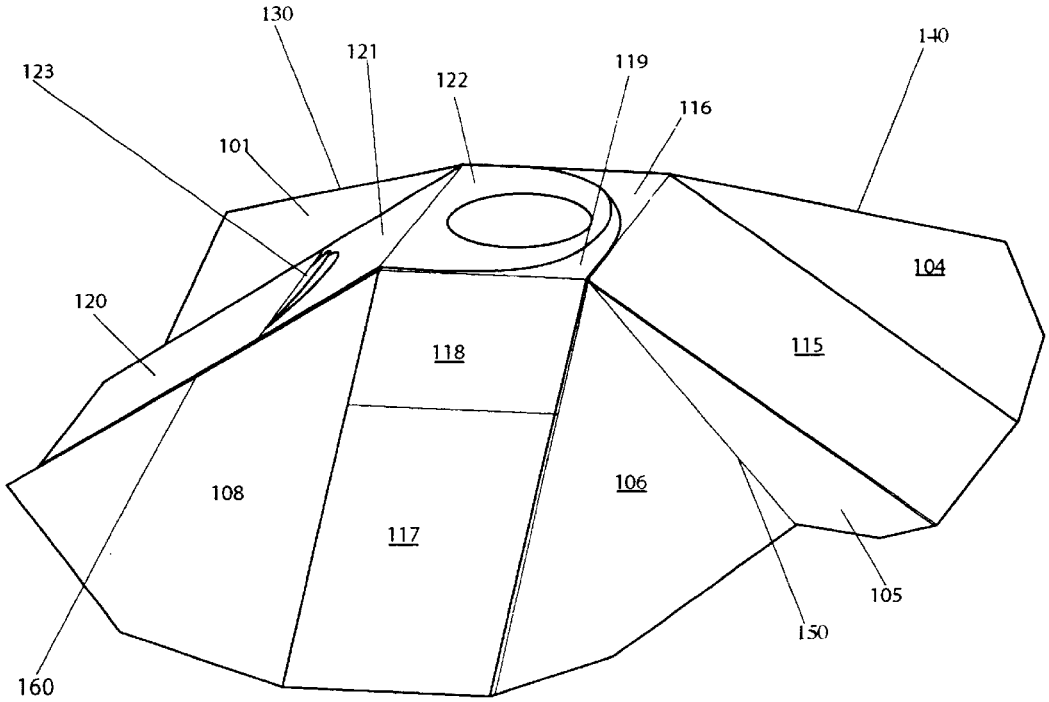
FIG. 12 illustrates a third example shade formed from an example foldable sheet, according to an example embodiment of the present invention.

FIG. 12 illustrates a third example shade formed from an example foldable sheet, according to an example embodiment of the present invention. The extending members that were attached to the rest of the foldable sheet in FIG. 10, can be secured on top of the rest of the foldable sheet, as illustrated in FIG. 12. The fold lines may then be pulled upwards to form the shade shown illustrated in FIG. 12. The shade may be held together by a screw shell for a light bulb, or by other conventional attachments, e.g., glue, snaps, Velcro, etc.

First Alternative Embodiment

In the first alternative example embodiment of the present invention, an example foldable sheet for use as a candle holder. The example foldable sheet may be formed into package for holding an object, in particular for a candle or set of candles. This package may also be refolded for use as a candleholder or shade for a candle. It will be appreciated that it may be advantageous to use a fire resistant foldable material for the container for the object, e.g., wire mesh, metal foil, etc.

Figure 13:
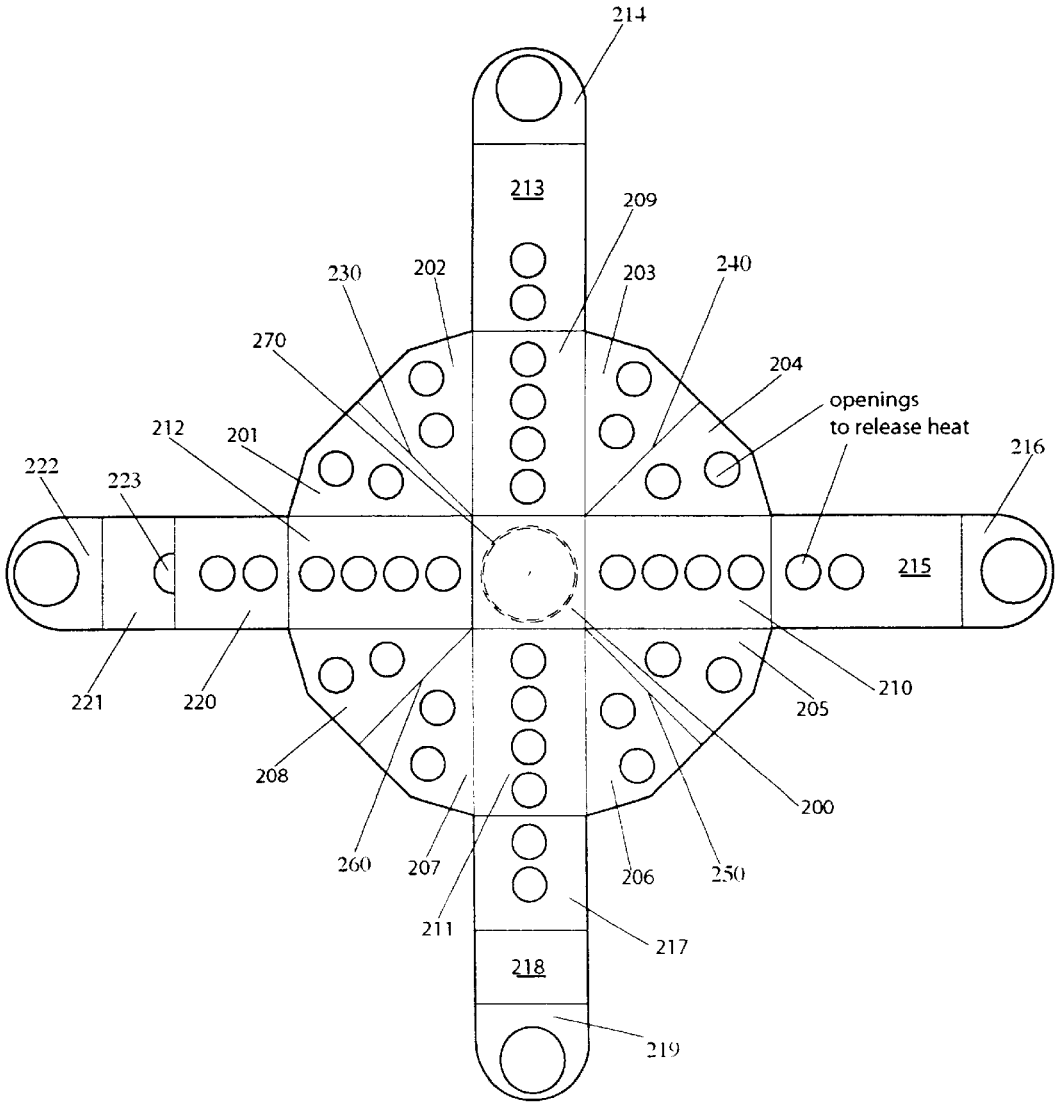
FIG. 13 illustrates an example foldable sheet, according to the first alternative example embodiment of the present invention.

FIG. 13 illustrates an alternative example foldable sheet, according to the first alternative example embodiment of the present invention.

The alternative example unfolded sheet may include a center section 200. In the first alternative example embodiment, the center section does not include an aperture. An example candle 270 is shown resting on the center section 200.

The example unfolded sheet may contain intermediate panels 201–208, and side panels 209–212. The intermediate panels 201–208 and side panels 209–212 may be disposed in a radial fashion, with two intermediate panels between each pair of side panels. The side panels 209–212 are illustrated in FIG. 13 as rectangles, and the intermediate panels 201–208 are illustrated as wedge shapes, but it will be appreciated that other shapes may be employed. Each pair of adjacent side panels may be connected by a pair of side panels, e.g., panels 209 and 210 may be connected by panels 203 and 204, with panel 203 joined to panel 209 and panel 204 joined to panel 210, and panels 203 and 204 joined to each other.

The alternative example foldable sheet may include one or more radially extending members, e.g., four such radially extending members are included in the alternative example foldable sheet illustrated in FIG. 13. Each radially extending member may include a connecting panel, which may be joined to a side panel. For example, a connecting panel 213 may be joined to side panel 209. Similar connecting panels 214–216 may be joined to side panels 210–212, respectively. It will be appreciated that the extending members could have other dimensions, or take on other shapes, e.g., the extending members might extend tangentially to the end of the connecting panels.

The first radially extending member in the alternative example sheet may be formed by panels 213 and 214. The connecting panel 213 may connect side panel 209 to an attachment panel 214. The panel 214 may be configured to form an attachment, for attaching the first radially extending member to another object or to another component of the alternative example foldable sheet. For example, as illustrated in FIG. 13, the panel 214 may be a semicircular panel which includes a ring shaped opening to form loop. However, it will be appreciated that the attachment 214 need not be ring shaped, e.g., it may include a hook, a loop of wire joined to a panel, a Velcro closure, a snap, a closable clasp, or any other structure that could be used for attachment to another object. It will also be appreciated that the opening need not be present in the attachment panel when it is manufactured and distributed, e.g., the attachment panel may include a perforated disk that could be removed by an end user of the unfolded sheet.

Panels 215 and 216 may form a second radially extending member of the example foldable sheet. Side panel 210 may be connected via connecting panel 215 to attachment panel 216.

Panels 217, 218, and 219 may form a third radially extending member of the example foldable sheet. Side panel 211 may be joined to connecting panel 217, which may be in turn be joined to fold under connecting panel 218, which in turn may be joined to attachment panel 219.

Panels 220, 221, and 222, may form a fourth radially extending member of the example foldable sheet. Side panel 212 may be joined to connecting panel 220, which may be joined to fold under connecting panel 221, which may be joined to attachment panel 222. Fold under connecting panel 221 may include a tab 223. The tab may be a half circle, although it will be appreciated that other shapes may be used. Like the openings in the attachment panels, the tab 223 may be perforated and punched out by an end user. Alternatively, the tab may be omitted, or may be marked by a pre-printed line and cut out by hand, although this approach may make the use of the unfolded sheet more complex.

In the alternative example foldable sheet, elements 201–212, 213, 215 and 220 all contain openings to facilitate the release of heat and to allow air to feed the candle flame. These openings may be pre-perforated circles that may be removed by the end user of the candle shade. These openings may also have other forms as desired, to allow the candle to give of a decorative pattern of light and shadow. The use of a reflective material or translucent material for the container for the object may enhance the aesthetic qualities of the candle holder.

Figure 14:
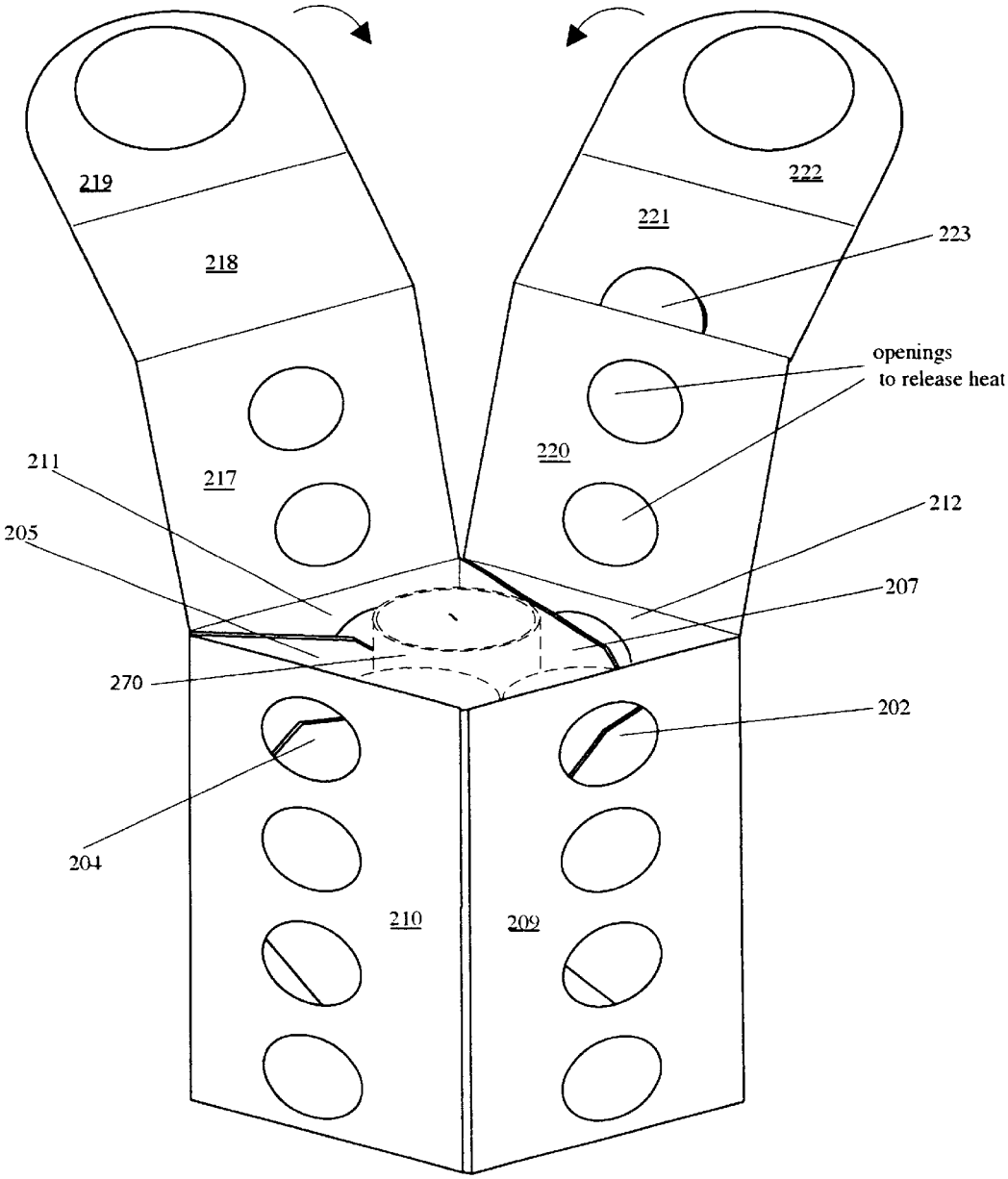
FIG. 14 illustrates an example container for a candle formed from the example foldable sheet, according to the first alternative example embodiment of the present invention.

FIG. 14 illustrates an example container for a candle formed from the example foldable sheet, according to the first alternative example embodiment of the present invention. For shipping, storage, or point of sale purposes, the folded container may accommodate a single large or a number of small candles. It will be appreciated that the size of the container may be varied as desired, in order to have the correct dimensions for the candles with which the container is intended to be used with. Alternatively, inserts could be used to adjust the internal volume and dimensions of the container.

Figure 15:
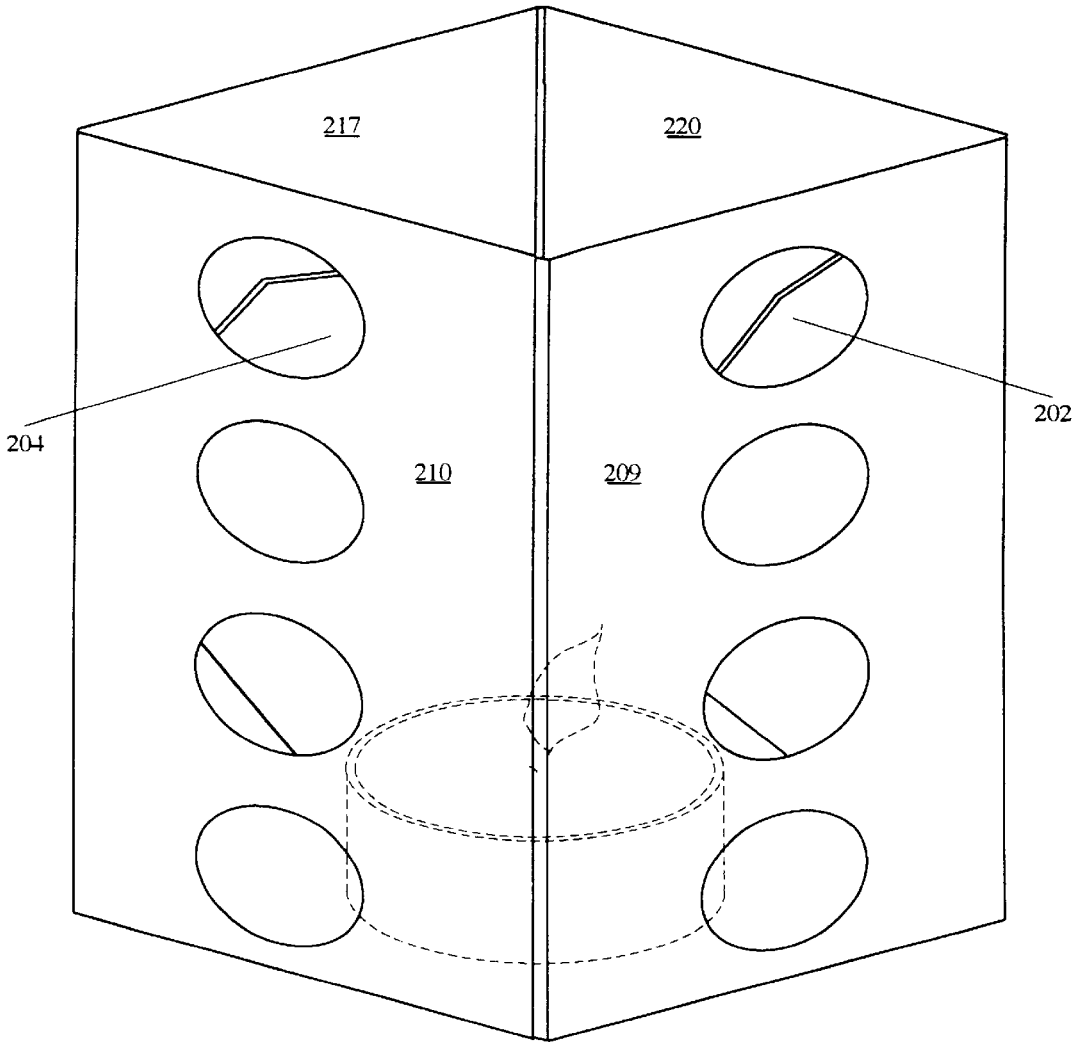
FIG. 15 illustrates the use of the example container as a candle holder, according to the first alternative example embodiment of the present invention.

FIG. 15 illustrates the use of the example container as a candle holder, according to the first alternative example embodiment of the present invention. As can be seen from the illustration, the extending members have all been tucked into the container.

Figure 16:
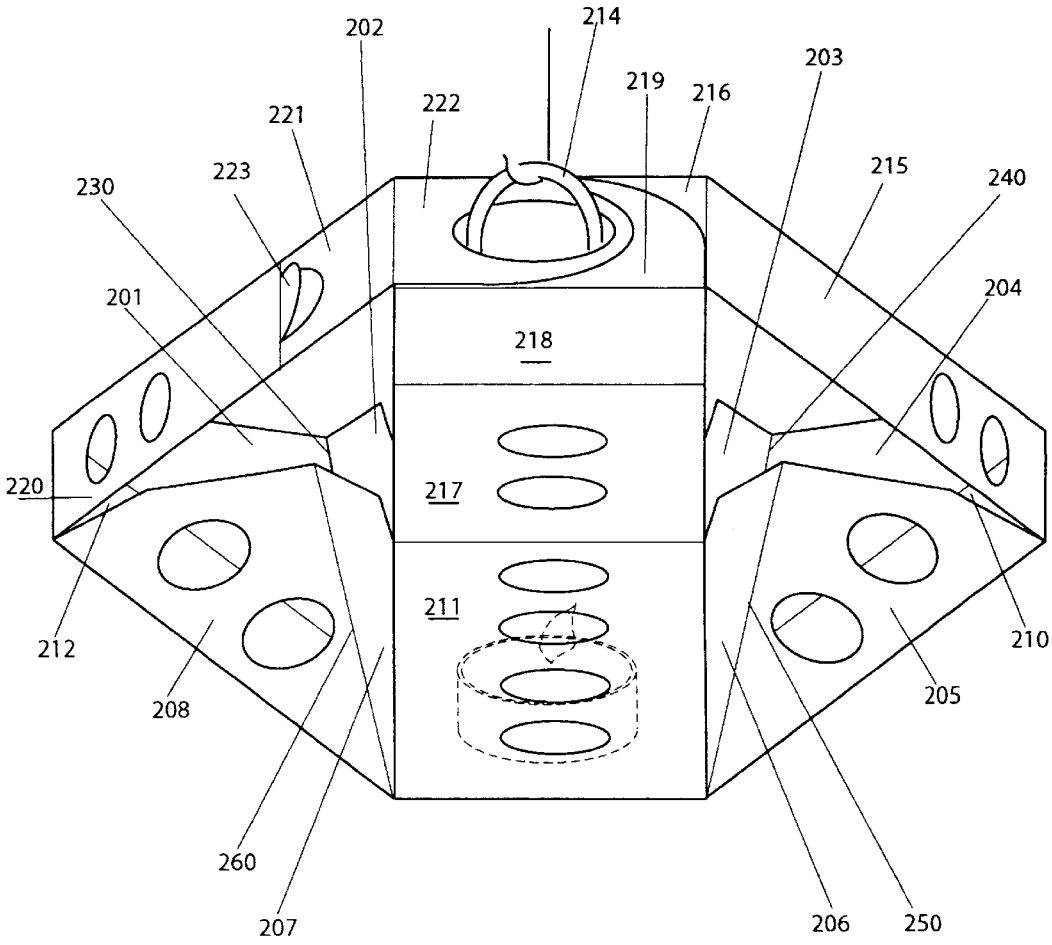
FIG. 16 illustrates the use of the foldable sheet as a hanging candle holder and shade, according to the first alternative example embodiment of the present invention.

FIG. 16 illustrates the use of the foldable sheet as a hanging candle holder and shade. The attachment panel 214 may be replaced by a loop that is small enough to pass through the apertures in the other attachment panels. Alternatively, the attachment panel 214 is made from a material that is sufficiently flexible to pass through the apertures in the other attachment panels. This allows the basket-shaped hanging candle holder to be suspended from a hook attached to the attachment panel 214, as illustrated in FIG. 16. Alternatively, one or more of the attachment panels could be hook shaped, allowing them to be attached to a hook, ring, peg, etc.

Second Alternative Embodiment

Figure 17:
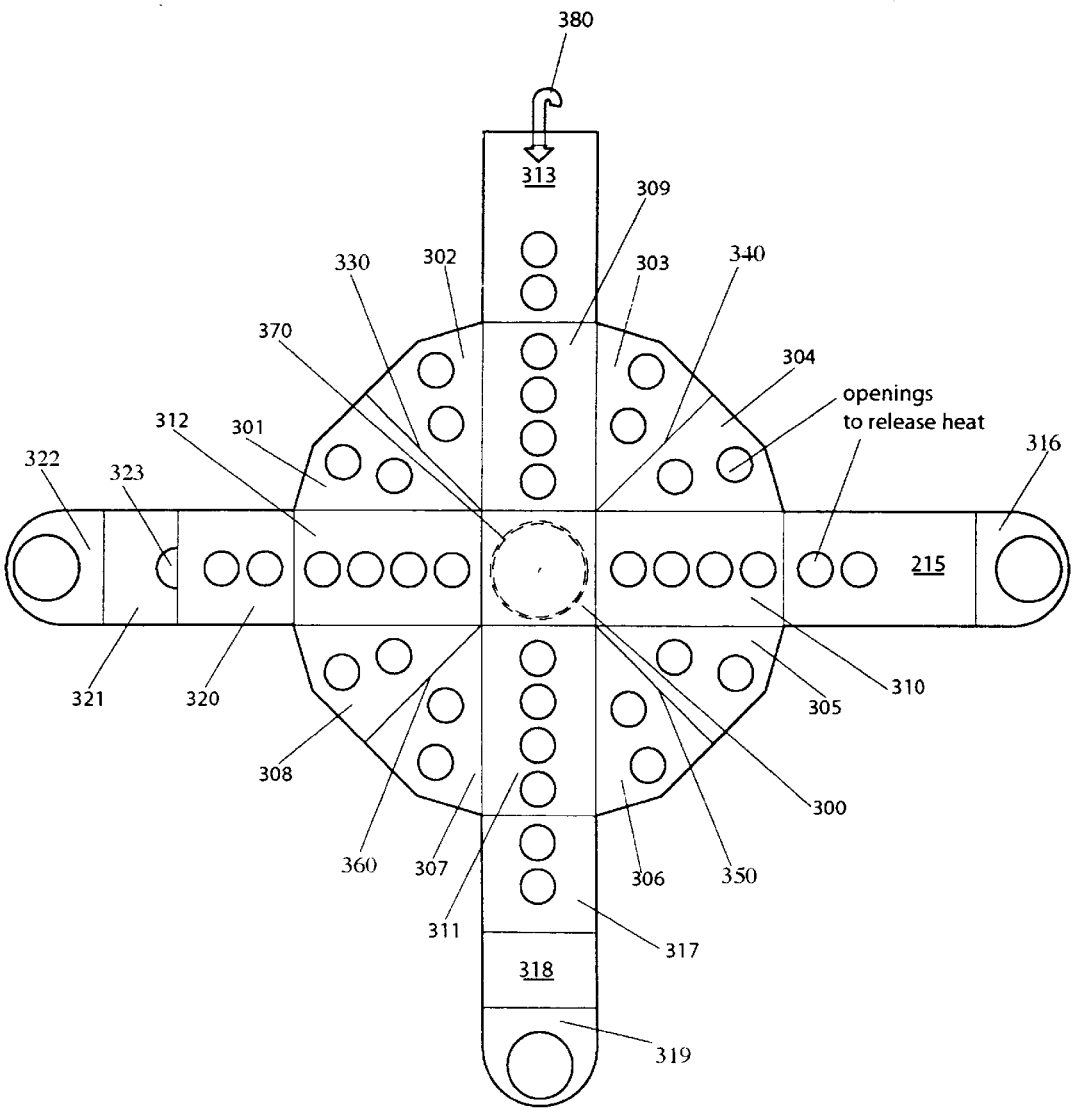
FIG. 17 illustrates an example foldable sheet, according to a second alternative example embodiment of the present invention.

FIG. 17 illustrates an example foldable sheet, according to a second alternative example embodiment of the present invention. Like the second alternative example embodiment, holes may be included in many of the panels. The foldable sheet may be provided with a metal hook 380 attached to connecting panel 313. In the second alternative example embodiment, the metal hook may attached through a slot in connecting panel 313. The metal hook 380 and the connecting panel 313 form an attachment which may be used to attach the foldable sheet to another object, as will be illustrated below. It will be appreciated that other forms of attachments may be provided, e.g., rings, wires, etc. If the material of the foldable sheet is sufficiently stiff, the hook may be integrally formed from the material of the foldable sheet. Also, other procedures for linking the metal hook and the connecting panel may be used, e.g., glue, folding a flap over a wire and gluing it the connecting panel, etc.

The example foldable sheet illustrated in FIG. 17 may be folded to form a box for holding a candle, in the same manner as was previously shown for the containers in FIGS. 4, 5, and 14. It will be appreciated that it may be preferable to close panel 313, which is shorter than the other extending members, so that it is secured by the longer extending members when the box is closed.

Figure 18:
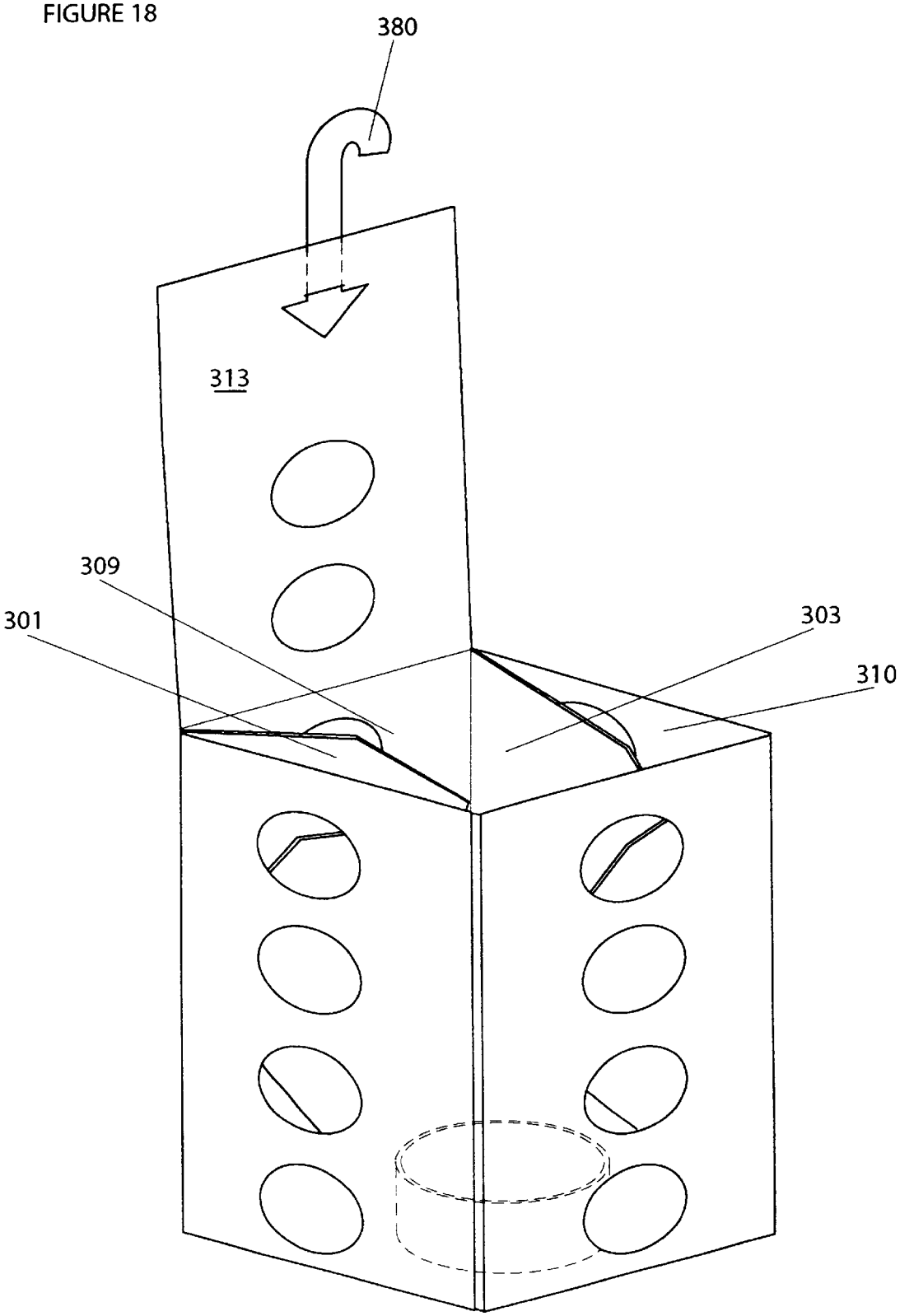
FIG. 18 illustrates the example foldable sheet formed into a hanging candle holder, according the second alternative example embodiment of the present invention.

FIG. 18 illustrates the example foldable sheet formed into a hanging candle holder, according the second alternative example embodiment of the present invention. The box may be opened and the attachment hook 380 inserted in the slot in panel 313 to form an attachment, as illustrated in FIG. 18. Using the attachment, the candle holder may be suitable for hanging on a post, wall, or door, e.g., with the attachment hooked on a nail, peg, or picture hanger.

Third Alternative Example Embodiment

The third alternative example embodiment may be formed into a container for shipping a flower bulb or seeds, and may be re-folded to form a hanging flower basket.

Figure 19:
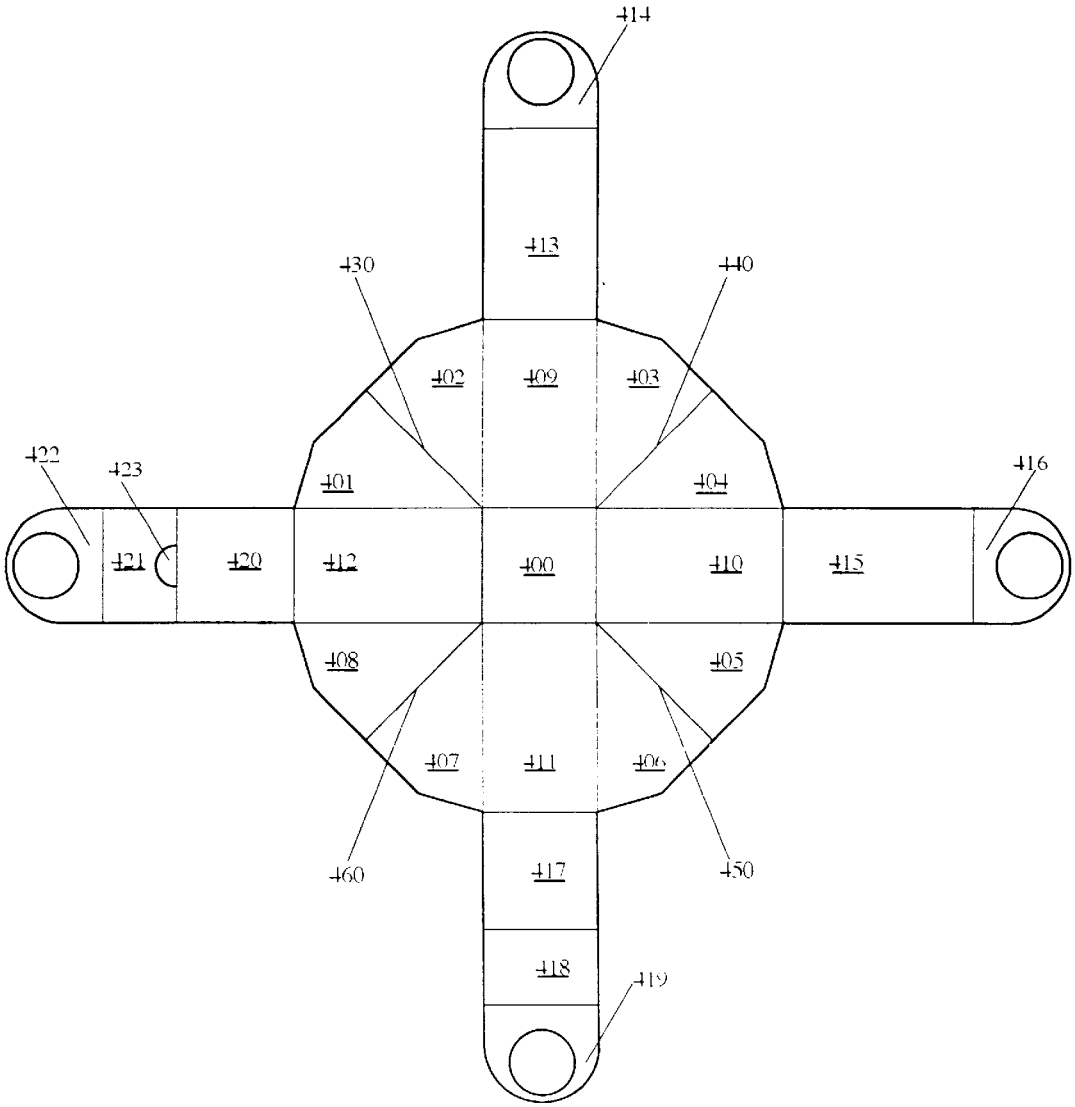
FIG. 19 illustrates an example foldable sheet, according to a third alternative example embodiment of the present invention.

FIG. 19 illustrates an example foldable sheet, according to a third alternative example embodiment of the present invention. The foldable sheet may be manufactured from a water-resistant material, e.g., foldable plastic, Mylar, metal foil, etc.

The third alternative example unfolded sheet may include a center section 400. No aperture is shown in the center section 400. A small hole may be desirable, as in the bottom of some conventional flower pots. However, such a hole may allow water leakage, which may be undesirable, depending on where the container is used, so it is omitted in the example.

The third alternative example unfolded sheet may contain intermediate panels 401–408, and side panels 409–412. The intermediate panels 401–408 and side panels 409–412 may be disposed in a radial fashion, with two intermediate panels between each pair of side panels. The side panels 409–412 are illustrated in FIG. 19 as rectangles, and the intermediate panels 401–408 are illustrated as wedge shapes, but it will be appreciated that other shapes may be employed. Each pair of adjacent side panels may be connected by a pair of side panels, e.g., panels 409 and 410 may be connected by panels 403 and 404, with panel 403 joined to panel 409 and panel 404 joined to panel 410, and panels 403 and 404 joined to each other.

The third alternative example foldable sheet may include one or more radially extending members, e.g., four such radially extending members are included in the alternative example foldable sheet illustrated in FIG. 19. Each radially extending member may include a connecting panel, which may be joined to a side panel. For example, a connecting panel 413 may be joined to side panel 409. Similar connecting panels 414–416 may be joined to side panels 410–412, respectively. It will be appreciated that the extending members could have other dimensions, or take on other shapes, e.g., the extending members might extend tangentially to the end of the connecting panels.

The first radially extending member in the third alternative example sheet may be formed by panels 413 and 414. The connecting panel 413 may connect side panel 409 to an attachment panel 414. The panel 414 may be configured to form an attachment, for attaching the first radially extending member to another object or to another component of the alternative example foldable sheet. For example, as illustrated in FIG. 19, the panel 414 may be a semicircular panel which includes a ring shaped opening to form loop. It will be appreciated that panel 414 may actually be fabricated as a smaller ring than the one shown in FIG. 19, e.g., to facilitate inserting this ring through the other rings, as will be illustrated below. It will be appreciated that the attachment panel 414 need not be ring shaped, e.g., it may include a hook, a loop of wire joined to a panel, a Velcro closure, a snap, a closable clasp, or any other structure that could be used for attachment to another object. It will also be appreciated that the opening need not be present in the attachment panel when it is manufactured and distributed, e.g., the attachment panel may include a perforated disk that could be removed by an end user of the unfolded sheet.

Panels 415 and 416 may form a second radially extending member of the example foldable sheet. Side panel 410 may be connected via connecting panel 415 to attachment panel 416.

Panels 417, 418, and 419 may form a third radially extending member of the example foldable sheet. Side panel 411 may be joined to connecting panel 417, which may be in turn be joined to fold under connecting panel 418, which in turn may be joined to attachment panel 419.

Panels 420, 421, and 422, may form a fourth radially extending member of the example foldable sheet. Side panel 412 may be joined to connecting panel 420, which may be joined to fold under connecting panel 421, which may be joined to attachment panel 422. Fold under connecting panel 421 may include a tab 423. The tab may be a half circle, although it will be appreciated that other shapes may be used. Like the openings in the attachment panels, the tab 423 may be perforated and punched out by an end user. Alternatively, the tab may be omitted, or may be marked by a pre-printed line and cut out by hand, although this approach may make the use of the unfolded sheet more complex.

Figure 20:
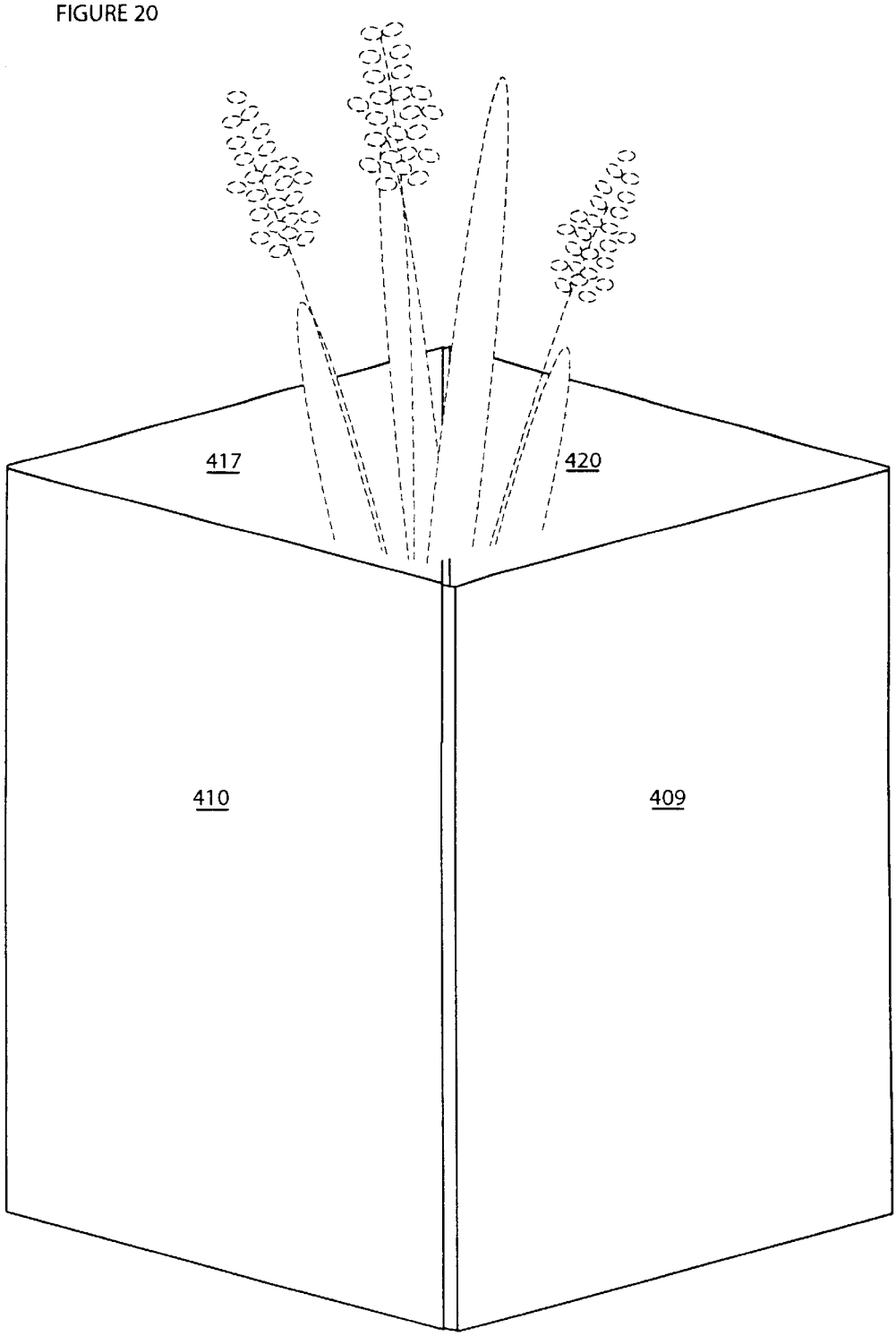
FIG. 20 illustrates an example container for an object formed from an example foldable sheet, according to a third alternative embodiment of the present invention.

FIG. 20 illustrates an example container for an object formed from an example foldable sheet, according to a third alternative embodiment of the present invention. The foldable sheet may be formed into a box for shipping a flower bulb or seed, in a similar manner to the container shown in FIG. 5. If the foldable sheet is manufactured from a water-resistant material, and the extending members are trimmed off or tucked in, the container may be used as a flower pot or vase, as illustrated in FIG. 20.

Figure 21:
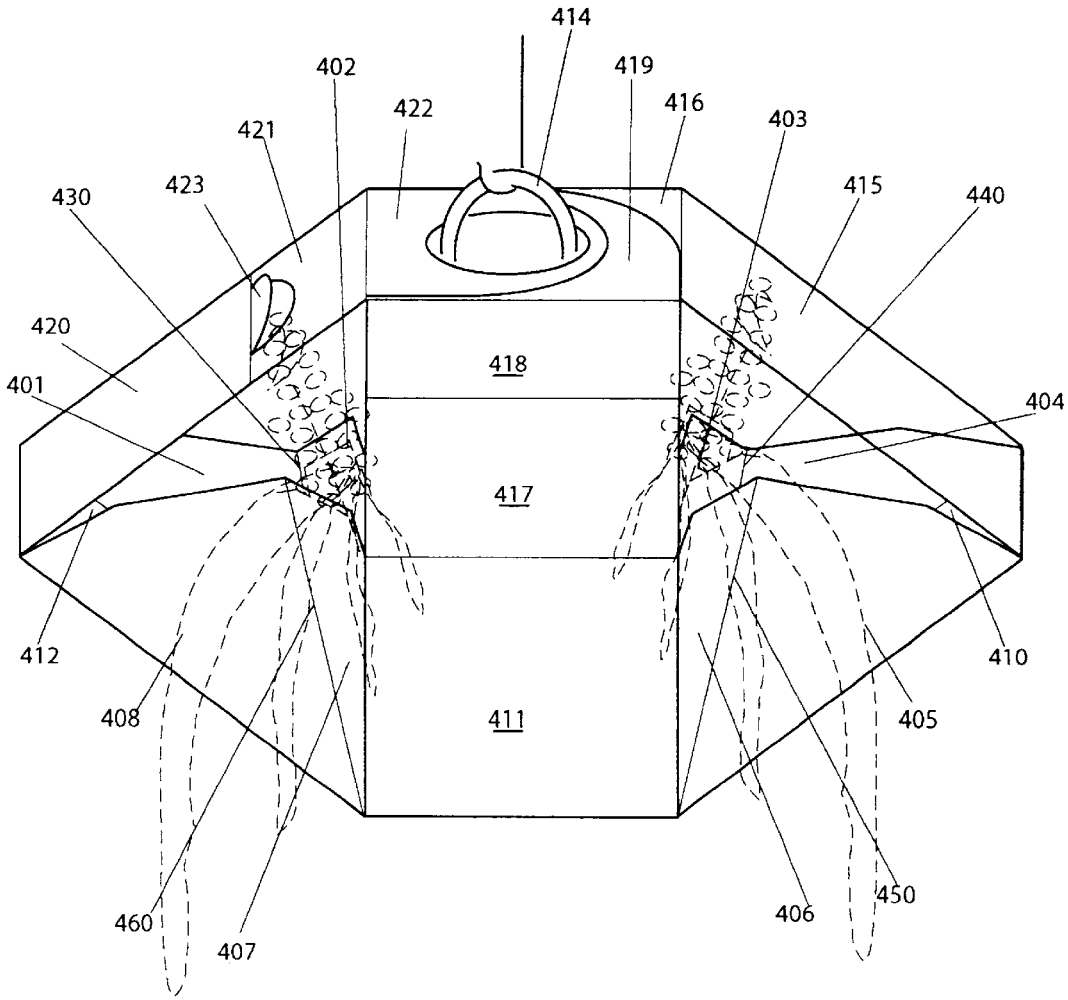
FIG. 21 illustrates the example foldable sheet refolded to form a hanging flower basket, according to a third alternative example embodiment of the present invention.

FIG. 21 illustrates the example foldable sheet refolded to form a hanging flower basket, according to a third alternative example embodiment of the present invention. The container shown in FIG. 20 may be unfolded and refolded to form a basket shaped object, e.g., a hanging basket for holding the flower bulb or plant that was originally packaged in the container. The basket shaped object is folded from the foldable sheet in the same manner as previously described in forming the shade in FIG. 7, except that the attachment panel 414 maybe inserted through the openings in the other attachment panels. The attachment panel 414 may then be attached to a hook, as illustrated in FIG. 21. It will be appreciated that other attachment devices and procedures may be provided, e.g., one or more of the attachment panels might be replaced by a hook.

Modifications

In the preceding specification, the present invention has been described with reference to specific example embodiments thereof. It will, however, be evident that various modifications and changes may be made thereunto without departing from the broader spirit and scope of the present invention as set forth in the claims that follow. The specification and drawings are accordingly to be regarded in an illustrative rather than restrictive sense.

What is claimed is:

1. An article of manufacture, comprising:

a light source:

a sheet of foldable material configured to be folded a first way to form a container for the light source, the sheet configured to be folded a second way to form a shade for the light source;

a side panel configured to form an outer wall of the container when the sheet is folded the first way;

an extending member connected to and extending outwardly from the side panel, the extending member configured to form a cover for the container when the sheet is folded the first way, the extending member also configured to attach the shade to the light source when the sheet is folded the second way.

2. The article of manufacture of claim 1, wherein the extending member comprises a loop configured to attach the shade to the light source when the sheet is folded the second way.

3. The article of manufacture of claim 2, wherein the loop is configured to serve as a closure tab for the cover when the sheet is folded the first way.

4. The article of manufacture of claim 1, wherein the sheet of foldable material is marked with a first set of fold lines indicative of folds that are made when folding the sheet the first way.

5. The article of manufacture of claim 4, wherein the sheet of foldable material is marked with a second set of fold lines indicative of folds that are made when folding the sheet the second way.

6. The article of manufacture of claim 1, further comprising:

an attachment configured to allow the shade to hang from another object.

7. The article of manufacture of claim 6, wherein the attachment comprises a hook.

8. The article of manufacture of claim 7, wherein the light source is a candle and the container is formed from a flame resistant material.

9. The article of claim 1, wherein the light source is a light bulb.

10. The article of claim 1 wherein the extending member is sufficiently long to extend completely across an open end of the container.

11. An article of manufacture, comprising:

a light source, and a container for the light source, the container configured to be refolded into a shade for the light source, the container including a first end, a second end, a first side panel, the first side panel positioned between the first end and the second end, a second side panel, the second side panel connected to the first side panel, the first and second side panels forming outer walls for the container, a flap, the flap coupled to and extending outwardly from the first side panel and configured to form a closure for the first end, the flap configured to attach the shade to the light source when the container is refolded into the shade.

12. The article of manufacture of claim 11, further comprising:

an intermediate panel, the intermediate panel joined to the first side panel and connected to the second side panel, the intermediate panel configured to be folded inside the container.

13. The article of manufacture of claim 11, wherein the flap comprises an attachment configured to attach the shade to the light source when the container is refolded into the shade for the light source.

14. The article of manufacture of claim wherein the attachment comprises a loop.

15. The article of manufacture of claim 13, wherein the attachment comprises a hook.

16. The article of manufacture of claim 13, wherein the attachment is configured to form a closure tab for the closure formed by the flap.

17. The article of manufacture of claim 13, wherein the flap further comprises:

a connecting panel, the connecting panel joined to the first side panel and connected to the attachment, the connecting panel configured to form an end panel for the first end of the container when the first end of the container is closed using the flap.

18. The article of claim 11, wherein the light source is a light bulb.

19. The article of claim 11 wherein the flap is sufficiently long to extend completely across the first end.

* * * * *